US005330326A

United States Patent [19]

Kuehne et al.

[11] Patent Number: 5,330,326

[45] Date of Patent: Jul. 19, 1994

[54] METHOD FOR PRODUCING PROFILED PARTS BY GRINDING AND A TURBOMACHINE BLADE PRODUCED THEREBY

[75] Inventors: Ulrich Kuehne, Schwalbenweg 11, D-4230 Wesel; Karlheinz Heine, Wesel; Klaus Meyer, Neunkirchen am Brand; Klaus Rueschmann, Wesel, all of Fed. Rep. of Germany

[73] Assignee: Ulrich Kuehne, Erlangen, Fed. Rep. of Germany

[21] Appl. No.: 11,217

[22] Filed: Jan. 29, 1993

Related U.S. Application Data

[62] Division of Ser. No. 189,764, May 3, 1988, Pat. No. 5,205,081.

[30] Foreign Application Priority Data

May 4, 1987 [DE] Fed. Rep. of Germany ..... 3714805

[51] Int. Cl.[5] ..... B24B 1/00

[52] U.S. Cl. ..... 416/248; 416/223 R; 29/889; 51/281 R

[58] Field of Search ..... 51/281 R, 327, 144; 29/889.2, 889; 416/223 R, 248

[56] References Cited

U.S. PATENT DOCUMENTS 2,606,406 8/1952 Mueller ..... 51/144
2,656,651 10/1953 Seyferth ..... 51/144
4,193,314 3/1993 Wormley et al. ..... 51/165.71

FOREIGN PATENT DOCUMENTS 8900479 1/1989 PCT Int'l Appl. ..... 51/281 R

*Primary Examiner*—Robert A. Rose
*Attorney, Agent, or Firm*—Herbert L. Lerner; Laurence A. Greenberg

[57] ABSTRACT

A method for producing a profiled part from a blank, wherein the cross-sectional profile of the part to be produced differs in some portions both quantitatively and qualitatively from the cross-sectional profile of the blank, so that different amounts of material must be removed between a starting profile of the blank and a desired final profile of the part includes pre-shaping and finish-grinding the part to be produced in one chucking position with at least one profiled grinding wheel. The blank is translated and rotated relative to the at least one profiled grinding wheel during the pre-shaping step for giving the blank approximately a desired profile. The finish-grinding step is performed at least partially after the pre-shaping step for smoothing surfaces and producing the final profile to accurate dimensions. A turbomachine blade, an intermediate product for the turbomachine blade and a method of manufacturing the interim product are also provided.

10 Claims, 1 Drawing Sheet

METHOD FOR PRODUCING PROFILED PARTS BY GRINDING AND A TURBOMACHINE BLADE PRODUCED THEREBY

This is a division of application Ser. No. 07/189,764, filed May 3, 1988, now U.S. Pat. No. 5,205,081.

The invention relates to a method for producing a profiled part or section from a blank, wherein the cross-sectional profile of the part to be produced differs in some portions both quantitatively and qualitatively from the cross-sectional profile of the blank, so that different amounts of material must be removed between the starting profile and the final profile; a turbomachine blade produced according to the method having a convex suction side, a concave pressure side, a root in the form of retention means having ribs and/or grooves and a top which can be joined together with adjoining blades to form a closed shroud band; an associated intermediate product; and a method of producing the intermediate product.

The production of profile sections, such as turbomachine blades, especially relatively small blades, is often very labor-intensive, because of their complicated shape. Metal-cutting machining methods previously used necessitate many operations with different chucking or clamping devices and machining tools.

Although it is also known to use grinding machines in metal-cutting machining, this was previously not considered useful in preforming complicated profile sections in which the cross-sectional profile to be produced differs considerably from the cross-sectional profile of the blank. In known grinding methods, only flat, simply shaped or round surfaces are typically machined, and a constant relative speed between the workpiece and the grinding wheel is adhered to.

In the article entitled "Schleifen von Rohteilen mit geregeltem Zeitspanvolumen" [Grinding of Unmachined Parts at a Regulated Metal-Cutting Volume per Unit of Time], VDI-Z [Journal of the Association of German Engineers], Vol. 128 (1986), No. 23/24, December (I/II), pp. 935–939, possible control modes in the finish-grinding of unmachined parts are disclosed, but this article addresses only simple profile sections, such as round ones and applies only to the final production step of roughing and smoothing. The problems that arise in pre-shaping profile segments from a blank, in which a great deal of material must be removed at some portions of the cross section while at other portions only a little material must be removed, as is the case for example in turbomachine blades, are not addressed.

German Published, Non-Prosecuted Application DE-OS 22 43 863 discloses a grinding apparatus for the machining of turbomachines, but this reference relates only to the final fine machining and not to the pre-shaping of a profile from a blank. For turbine blades in general, it is certainly known to use grinding methods in the final machining as well as in individual steps. Some problems that arise in full-width or deep grinding processes are already known from the journal "Werkstatt und Betrieb" [Shop and Factory], 118 (1985) 3, Munich, Federal Republic of Germany, pp. 149 et seq.. The problems of heat induction into the workpiece are also mentioned there. However, this publication does not discuss the pre-shaping of the actual blade profile, but only the machining of the blade ends and the final fine machining. The problems of the removal of quite different amounts of material between the starting and the final profile are not addressed.

It is accordingly an object of the invention to provide a method for producing profiled parts by grinding and a turbomachine blade produced thereby, which overcome the hereinafore-mentioned disadvantages of the heretofore-known methods and devices of this general type and which permits the most economical possible production of profiled parts or sections having a cross-sectional profile that differs considerably from the cross-sectional profile of the associated blank, at least in some portions. In particular, the invention relates to a turbomachine blade produced by this method, and to a typical associated intermediate product.

With the foregoing and other objects in view there is provided, in accordance with the invention, a method for producing a profiled part from a blank, wherein the cross-sectional profile of the part to be produced differs in some portions both quantitatively and qualitatively from the cross-sectional profile of the blank, so that different amounts of material or differences must be removed between a starting profile of the blank and a desired final profile of the part, which comprises pre-shaping and finish-grinding the part to be produced in one chucking or clamping position with at least one profiled grinding wheel; translating and rotating the blank relative to the at least one profiled grinding wheel during the pre-shaping step for giving the blank approximately a desired profile; and performing the finish-grinding step at least partially after the pre-shaping step for smoothing surfaces and producing the final profile to accurate dimensions. The grinding wheel may be continuously trimmed or dressed. The local grinding depths may be selected to be approximately identical to the amounts of material to be removed. The finish-grinding step may be performed completely after the pre-shaping step.

With the objects of the invention in view, there is also provided a turbomachine blade, comprising a convex suction side, a concave pressure side, a root forming retention means having an uneven outer surface such as with ribs formed thereon and/or grooves formed therein, and a top to be joined together with adjoining blades to form a closed shroud band, at least the root, top and convex suction side having deeply ground contours produced in one chucking position, such as by being pre-shaped and finished by grinding.

In accordance with another feature of the invention, the blade is formed from a basic material, the suction side has a leading edge and a trailing edge, and the blade does not exhibit major structural changes as compared with the basic material in the vicinity of the suction side and the leading and trailing edges thereof. In any case, the blade does not exhibit structural changes more severe than in conventional machining processes as compared with the basic material.

Such a turbomachine blade may be considered a typical example to which the invention applies.

With the objects of the invention in view, there is furthermore provided an intermediate product for a turbomachine blade, comprising an elongated metal or steel block block having an approximately rectangular or parallelogram-like cross-section with a length of from 5 to 30% and preferably approximately 20% greater than the length of the blade to be produced; a suction side contour, a root contour and a top contour of the blade at least partly or entirely ground into the metal block, and remaining pieces having the original cross section of the metal block protruding from both the root and the top contours; and the root contour and the top contour having lengthwise dimensions slightly exceeding actual dimensions to be produced, preferably by at least the cutting width of a saw or cutting device.

In accordance with a further feature of the invention, the remaining pieces have a length projecting from the root and top contours by at least 2 mm.

In accordance with an added feature of the invention, the root and top contours have an excess of between 0.5 and 4 mm and preferably approximately 3 mm.

In accordance with an additional feature of the invention, the leading and trailing edges have a connecting plane therebetween, and including a pressure side contour preground at least as far as the connecting plane.

With the objects of the invention in view, there is additionally provided a method for producing an intermediate product for a turbomachine blade, which comprises fastening both ends of an elongated metal block, preferably having a rectangular or parallelogram-like cross section, in a chucking position; and grinding contours for a suction side, a blade root and a blade top in the metal block while rotating the metal block about the longitudinal axis of the metal block and translating the metal block relative to a high-speed grinding wheel, and tilting the metal block about a predetermined angle producing a radial tapering of a blade without changing the chucking position.

In order to understand the principle of the substance of the invention, the various technical conditions that prevail in pre-shaping and finish-grinding should be discussed. Economic considerations are also critical in determining whether or not a grinding method is technically feasible. This means that on one hand the machining time must not be too long, and on the other hand wear of the grinding wheels must remain within reasonable limits. Furthermore, the quality of the profile section to be produced must not suffer. In finish-grinding only very small volumes are removed per unit of time, so that thermal problems hardly arise. However, in pre-shaping large volumes must be removed per unit of time, and because of the associated high induction of heat into the workpiece and the grinding wheel, this is not completely unproblematical. In complicated profile sections such as turbomachine blades, there are regions in which a very great deal of material must be removed and other regions where only little material need be removed. This necessitates a particular control of the feeds of rotation and translation.

Therefore, in accordance with another mode of the invention, there is provided a method which comprises regulating or controlling feeds for rotating and translating the blank relative to the grinding wheel during the pre-shaping step as a function of the amounts of material or differences to be removed with metal-cutting volume per unit of time following a predetermined function for producing the desired profile. The predetermined metal cutting function may be carried out in at least one of a location-dependent and time-dependent manner or it may be held constant at least in some portions.

In accordance with a further mode of the invention, there is provided a method which comprises performing the pre-shaping step with a first partial step having a large metal-cutting volume per unit of time approximating the final profile to be produced, and at least one subsequent partial step having a lesser metal-cutting volume per unit of time.

The rotations and translations of the blank relative to the grinding wheel are initially defined substantially by the profile to be produced. Only the speed of these movements, generally known as the feed speed, is freely selectable. In order to have an economical method, this feed speed must be as high as possible. Limits are set, however, by the induction of heat into the workpiece, among other factors. Depending upon the contour to be produced, the feed is therefore controlled or regulated in such a way that the volume of material to be removed per unit of time just matches a predeterminable function, preferably remaining approximately constant. In other words, the rotation and translation are each slowed down whenever a very large amount of material is to be removed at the site just being machined. In order to enable rapid grinding in uncritical regions and yet to avoid causing damaging structural changes on the surface of the contour to be finally produced, it is also possible to proceed in two or more steps, initially working with a large volume of material removed per unit of time and then with a smaller volume upon approaching the contour to be finally produced or in critical regions. In this way, the damaging induction of heat into the workpiece in pregrinding can be limited to the regions that will later be removed during the finish-grinding process.

In accordance with a concomitant mode of the invention, there is provided a method which comprises controlling or regulating metal-cutting volume per unit of time during the pre-shaping step as a function of heat dissipation in the blank or workpiece in the vicinity of a particular grinding location.

In this way, the entire set of factors including the blank, the profile to be produced and the machining status attained can be taken into account in defining an optimal function that the removal volume per unit of time is to follow. A decisive factor for the heating of the workpiece during grinding is the dissipation of heat away from the grinding location. Some of the heated material is removed directly afterward, for example, which makes that heat input uncritical. Furthermore, the dimensions of the workpiece and its thermal capacity and thermal conductivity (in short, thermal dissipation in the vicinity of the grinding location) must be taken into account. It is generally true that less volume should be removed by cutting per unit of time, where the heat dissipation at the grinding location is poorer. In very thin portions of the workpiece, for instance, the volume of material cut per unit of time sometimes has to be reduced.

A turbine blade according to the invention as described above can be produced particularly economically. By grinding all the non-concave contours of the blade in only one chucking position, many steps in the known methods of machining can be dispensed with. Manufacturing with very low tolerances is possible, since there are no longer any inaccuracies resulting from changing the chucking position of the workpiece. Considerable savings of production time are also attainable, because it is practically entirely unnecessary to provide for interim storage of entire batches of partially finished blades until a machine is refitted for new machining tools.

Other features which are considered as characteristic for the invention are set forth in the appended claims.

Although the invention is illustrated and described herein as embodied in a method for producing profiled parts by grinding and a turbomachine blade produced thereby, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
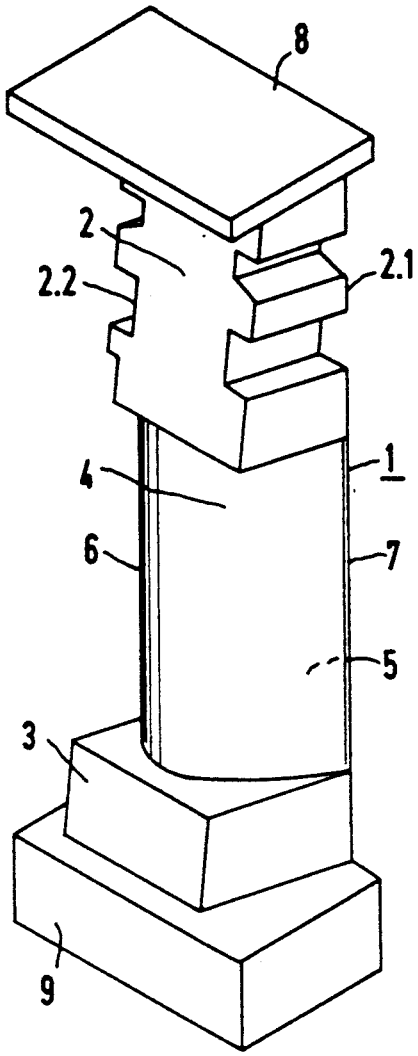
FIG. 1 is a diagrammatic perspective view of an intermediate product according to the invention.
Figure 2:
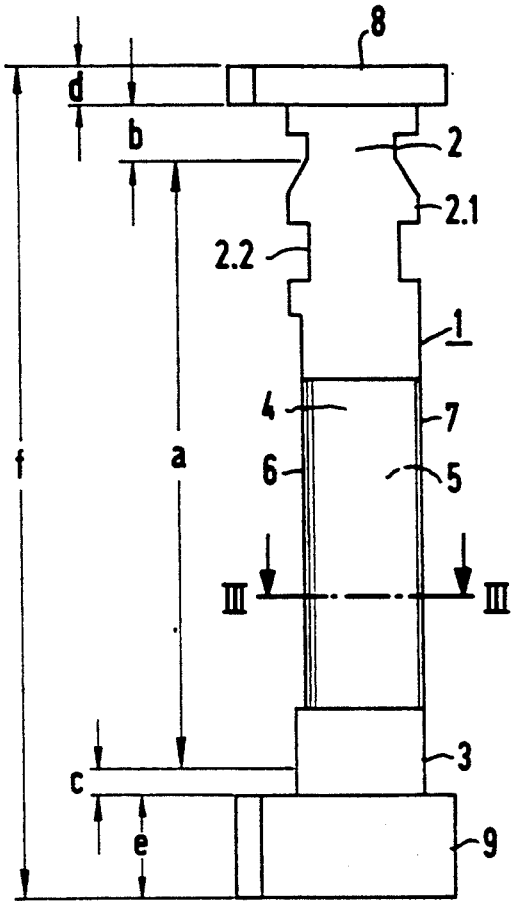
FIG. 2 is a side-elevational view of the product shown in FIG. 1.
Figure 3:
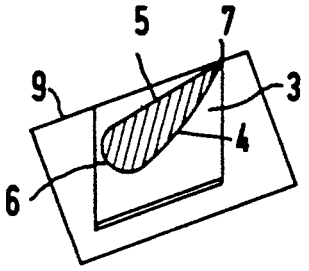
FIG. 3 is a cross-sectional view of the intermediate product taken along the line III—III in FIG. 2, in the direction of the arrows.

Referring now to the figures of the drawings in detail and first, particularly, to FIGS. 1 and 2 thereof, there is seen an intermediate product in the form of a profile part or section 1 which has a total length f that is greater than the length a of a blade to be produced. The blade itself is formed of a blade root 2 with ribs 2.1 and grooves 2.2 and may be used to form all of the root shapes known in the prior art. The blade also has a top 3, which has a cross section in the form of a parallelogram and which forms a closed shroud band together with other blade tops when later installed. As best seen in FIG. 3, the actual blade contour has a rounded leading edge 6, a pointed trailing edge 7 and a convex suction side 4. A pressure side 5, which will later be concave, is not yet finished in the intermediate product shown, but instead has only been ground flat. The contour of the blade root 2 is extended by a length b and the contour of the blade top 3 is extended by a length c. A cutting device can later be positioned in a defined manner in the vicinity of these extensions b, c. Furthermore, the intermediate product has two remaining pieces 8, 9 at the two ends thereof, which have lengths d and e, respectively, that are not necessarily identical. These remaining pieces serve to firmly clamp or chuck the blank or intermediate product firmly during the entire grinding process.

It should also be pointed out that the method according to the invention is intrinsically restricted to profiles that are less concave than that which corresponds to the shape of the smallest grinding wheels used, when new.

The present invention, for instance, permits the economical and precise production of blades for turbomachines, and very fast production is made possible by dispensing with many different steps. Production planning is simplified, because interim storage is dispensed with and the production time for an entire set of blades can be shortened considerably.

We claim:

1. Intermediate product for a turbomachine blade, comprising:

a) an elongated metal block having an original cross section and a length of from 5 to 30% greater than the length of the blade to be produced;

b) a suction side contour, a root contour and a top contour of the blade at least partly ground into said metal block, and remaining pieces having the original cross section of the metal block protruding from both said root and said top contours; and c) said root contour and said top contour having lengthwise dimensions slightly exceeding actual dimensions to be produced.

2. Intermediate product according to claim 1, wherein said elongated metal block has an approximately rectangular cross-section.

3. Intermediate product according to claim 1, wherein said length of said elongated metal block is approximately 20% greater than the length of the blade to be produced.

4. Intermediate product according to claim 1, wherein said lengthwise dimensions of said root contour and said top contour exceed the actual dimensions to be produced by at least the cutting width of a saw or cutting device.

5. Intermediate product according to claim 1, wherein said metal block is formed of steel.

6. Intermediate product according to claim 5, wherein said remaining pieces have a length projecting from said root and top contours by at least 2 mm.

7. Intermediate product according to claim 5, wherein said root and top contours exceed the actual dimensions to be produced by between 0.5 and 4 mm.

8. Intermediate product according to claim 5, wherein said root and top contours exceed the actual dimensions to be produced by approximately 3 mm.

9. Intermediate product according to claim 5, wherein the leading and trailing edges have a connecting plane therebetween, and including a pressure side contour preground at least as far as said connecting plane.

10. Intermediate product according to claim 1, wherein said elongated metal block has a parallelogram cross-section.

* * * * *